United States Patent [19]

Martin et al.

[11] 3,951,081

[45] Apr. 20, 1976

[54] METHOD AND APPARATUS FOR INCINERATING OF REFUSE

[75] Inventors: Walter Josef Martin; Heinz Weiand, both of Munich, Germany

[73] Assignee: Josef Martin Feuerungsbau GmbH, Munich, Germany

[22] Filed: June 26, 1974

[21] Appl. No.: 482,975

[30] Foreign Application Priority Data

June 27, 1973 Germany ..... 2332661

[52] U.S. Cl. ..... 110/8 P; 110/10; 110/106

[51] Int. Cl.[2] ..... F23G 5/02

[58] Field of Search ..... 110/8 R, 8 C, 8 P, 10, 110/15, 28 E, 28 F, 106

[56] References Cited

UNITED STATES PATENTS 3,769,921 11/1973 McMullen ..... 110/8

FOREIGN PATENTS OR APPLICATIONS 451,064 7/1936 United Kingdom ..... 110/28

908,055 4/1954 Germany ..... 110/28

*Primary Examiner*—Kenneth W. Sprague

*Attorney, Agent, or Firm*—Michael J. Striker

[57] ABSTRACT

A combustion chamber has a lower end provided with a grate, and an inlet admits unclassified refuse into a comminutor wherein it is comminuted and forms a heavier particle fraction and a lighter particle fraction. The fraction having the heavier particles is directly admitted onto the grate, whereas the fraction having the smaller and lighter particles is subjected to a second comminution to convert the smaller particles into fine particles which are then admitted, either directly or indirectly, into the combustion chamber upwardly of the grate so that they become incinerated in the combustion chamber while floating therein. A method of incinerating refuse is also disclosed.

10 Claims, 1 Drawing Figure

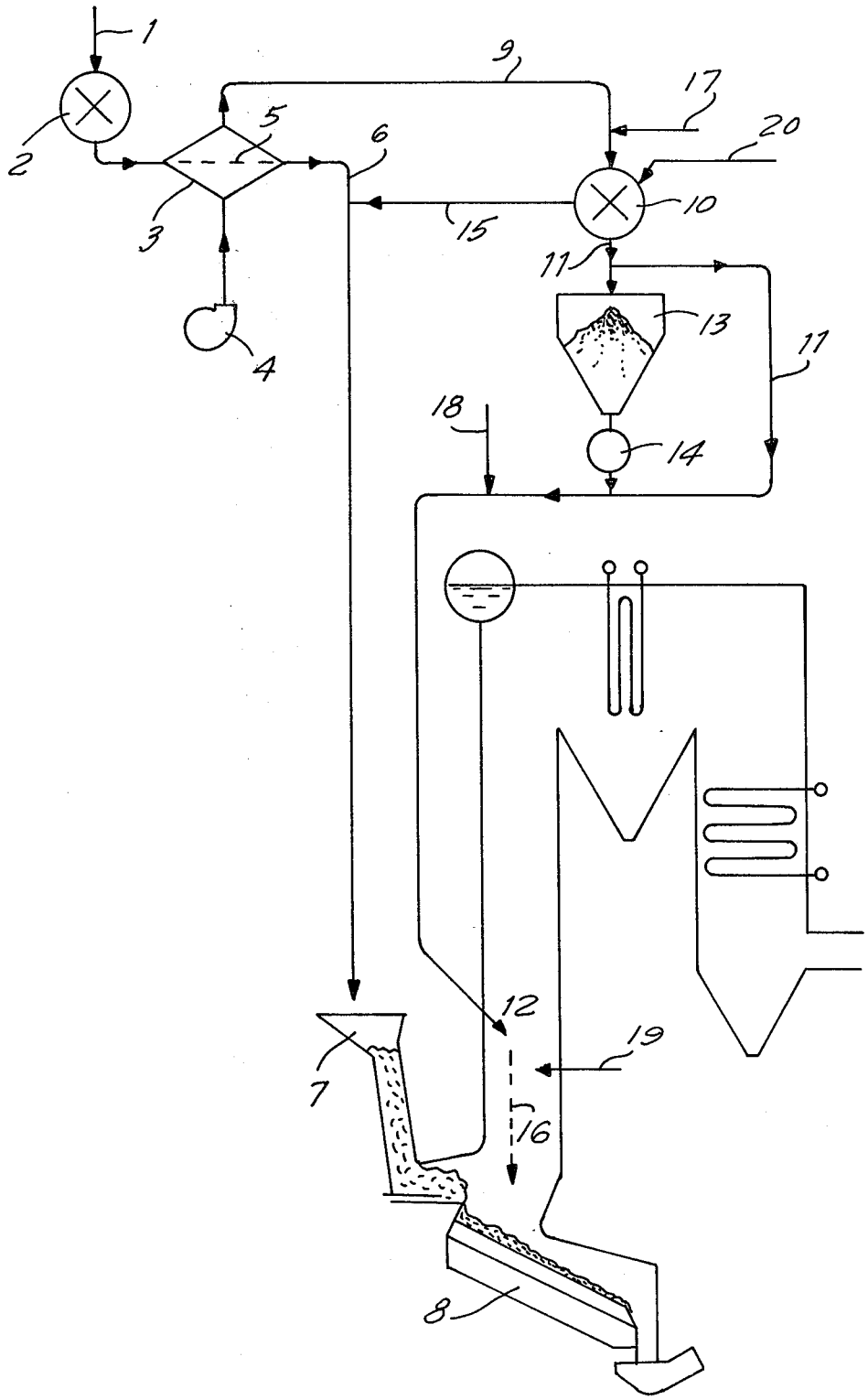
1
2
3
4
5
6
7
8
9
10
11
11
12
13
14
15
16
17
18
19
20

METHOD AND APPARATUS FOR INCINERATING OF REFUSE

BACKGROUND OF THE INVENTION

The present invention relates generally to the incineration of refuse, and more particularly to the incineration of unclassified refuse. In particular, the invention relates to a refuse incinerator for unclassified refuse, and to a method of effecting such incineration.

One of the most promising approaches to the disposal of refuse is its incineration. Many different approaches have been used to the incineration of such refuse, but in recent years the most promising one of these has been found to be the incineration of refuse particles while they float in a combustion chamber. This requires that the particles be first reduced to a size which permits them to float. When they are subsequently incinerated under these conditions, they float in hot air in the combustion chamber and are therefore more readily and more completely incinerated since the incineration takes place under turbulent conditions.

In order to render the refuse small enough for this purpose, it is known to provide comminutors into which the refuse is admitted and which are intended to comminute it to obtain fine particles which can float during combustion. However, it is evident that not all components of a refuse mix that is not classified can be incinerated to the necessary extent. The prior art has therefore provided classification devices which receive the comminuted refuse and remove from it those parts which have not been reduced in size to the necessary extent during the comminution, or which are specifically heavier than the other particles in the mix. It is these particles which would not burn in floating condition, and which would drop onto the fire grate of the combustion chamber. The thus segregated particles are then transported away and disposed of by dumping.

SUMMARY OF THE INVENTION

It is the general object of the present invention to provide an improvement over the prior art.

More particularly, it is an object of the invention to provide an improved method of incinerating unclassified refuse, which does not require the separate handling that is necessary in the prior art.

An additional object of the invention is to provide an improved refuse incinerator.

In keeping with the above objects, and with others which will become apparent hereafter, one feature of the invention resides in a refuse incinerator for unclassified refuse which, briefly stated, comprises combustion chamber means having a lower end provided with a fire grate, and first comminuting means for receiving and comminuting unclassified incoming refuse to convert it into a mix of particles of different sizes. Classifying means is provided for classifying the mix into a first fraction composed of heavier particles and a second fraction composed of lighter particles. First conduit means conducts the first fraction from the classifying means directly onto the grate, and second comminuting means is connected with the classifying means for receiving the second fraction therefrom, and for comminuting the second fraction into fine particles of still smaller size. Second conduit means conducts the fine particles into the combustion chamber upwardly of the grate for incineration in floating state.

The present invention makes it possible to admit all of the refuse in completely unclassified condition into the incinerator, and eliminates any necessity for separate handling of the refuse that cannot be incinerated in floating condition. Those particles which can be incinerated in floating condition are primarily paper, textiles, wood, food scraps and the like; that is, readily combustible and comminutable refuse which can be combusted in finely divided state and in floating condition.

It is no longer necessary to presort the refuse which is incoming from a variety of sources, and the arrangement for finely comminuting the refuse need not be particularly large, since only that fraction of the incoming refuse undergoes fine comminution, which is actually capable of being so comminuted and subsequently being incinerated in floating condition, whereas the coarser heavier fraction has already previously been segregated. This not only saves on installation costs, since the fine comminutor can be smaller than was previously possible, but it saves on energy because a smaller comminutor requires less energy to operate it. Even more importantly, however, the capacity for throughput per unit of time on an existing incinerator can be substantially improved by converting it in the relatively simple manner to operate according to the present invention. For example, the throughput capacity per unit of time of an existing incinerator can be increased if the amount of incoming refuse is increased, in that the excess amount of refuse, that is the refuse in excess of that for which the incinerator is inherently constructed, is admitted into the combustion chamber upwardly of the grate and combusted therein in floating condition.

Insofar as new incinerator construction is concerned, the present invention has a particular advantage. Such installations are generally built to be capable of handling the amount of refuse that is expected to be generated on a yearly basis for the next ten to fifteen years following the construction of the incinerator. This means that in the first years of operation these incinerators are not fully utilized, because not as much refuse is being generated on a yearly basis as the incinerator is capable of handling. However, utilizing the present invention the initial investment costs of such an incinerator can be smaller than would otherwise be the case. When subsequently the amount of refuse that is incoming begins to increase, it is not necessary to convert the incinerator but instead the throughput capacity of the incinerator can simply be increased by resorting to the floating state combustion of those particles of refuse which can be so incinerated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a diagrammatic view illustrating an incinerator installation according to the present invention.

DESCRIPTION OF THE PREFERRED EMBODIMENTS

The incinerator installation according to the present invention should be understood to be exemplary only, and not limiting. The FIGURE shows that the unclassified refuse, that is the refuse that is composed of many different types of refuse derived from different sources, is admitted at an inlet 1 into a comminutor 2, for example a hammermill, wherein it undergoes an initial comminution and loosening up. The comminuted refuse is then admitted into a classifying device 3, wherein it is classified into a coarser fraction and a finer fraction. The term coarser here refers not only to size but also to weight, and the term finer refers not only to size but again also to weight; this means that the material of the finer fraction is the type that can be subsequently incinerated in floating condition. The classification may take place by means of sifting screens and/or air stream classifiers in which the finer fraction floats out of the classifier with the air stream whereas the heavier fraction drops through the air stream in downward direction. For this purpose, a blower 4 may be provided which produces the air stream, and an oscillating screen 5 or the like may be provided.

The comminuted refuse thus leaves the classifier 3 in form of two streams of refuse particles, namely one stream of coarser and heavier particles which is admitted via a conduit 6 to a feeding device 7, such as an inclined chute, which feeds it onto the fire grate 8 that is located at the lower end of the upright combustion chamber 12. The second stream of refuse particles, composed of the specifically lighter blowable refuse particles, is admitted via the conduit 9 into a fine comminutor 10 wherein it is further comminuted until it reaches the particle size that is necessary for incineration in floating condition in the combustion chamber 12. Such a fine comminutor may be of the type that grinds the refuse, and these fine particles may be either admitted directly into the combustion chamber 12 via a conduit 11 and a blower, a belt conveyor or the like, or they may be first admitted into a bunker or reservoir 13 in which they are stored and from which they are withdrawn and admitted in metered quantities by a feeding device 14 into the combustion chamber 12. The device 14 may be on mechanical or hydraulic basis and of any type well known in the art.

Any refuse particles which even in the fine communitor 10 still cannot be comminuted to the necessary extent, are passed via a conduit 15 into a stream of particles flowing in the conduit 6, and are thus admitted directly onto the grate 8. Heavy particles 16, which do not completely burn in the combustion chamber 12, drop down onto the grate 8. The lighter particles are incinerated while they float in the combustion chamber 12 upwardly of the grate 8.

The operation and positioning of the necessary burner units for obtaining the desired incineration is, of course, well known and requires no detailed discussion. To further increase the incineration capacity of the incinerator, auxiliary burners 19 may be provided which communicate with the combustion chamber 12 and which may of the oil-fired type, the gas-fired type, or for instance a pulverized-coal fired type.

One of the problems facing many municipalities is how to dispose of sewage sludge. The present invention presents a way of solving this problem also, in that the refuse fraction destined for fine communiction and incineration in floating state may have admitted into it, either ahead of, behind of and/or in the comminutor 10, quantities of sewage sludge which then become incinerated with these particles. The drawing shows, therefore, that conduits 17 and 18 are provided which may communicate with the conduits 9 and 11, or only one of the conduits 17 or 18 may be provided, but in any case they admit sewage sludge into the refuse which will subsequently be combusted in floating condition in the combustion chamber 12. An additional conduit 20 may directly communicate with the comminutor 10, to admit sewage sludge into the same.

The proper combustion of sewage sludge admixed with the particles, in the manner described above, is possible according to the present invention in a particularly advantageous manner, because finely divided sewage particles have a high moisture absorption capability, so that wet sewage sludge can readily become admixed with them and be incinerated. The amount of sewage sludge that is admitted into the stream of fine particles per unit of time can be regulated in dependence upon the temperature prevailing in the combustion chamber 12. The higher the combustion chamber temperature, the more sewage sludge can be admitted, and vice versa.

Because in the present invention the time between the admission of sewage sludge into the stream of fine refuse particles, and the combustion reaction is very short, the combustion temperature in the chamber 12 can be controlled very readily. Moreover, the sewage sludge is admitted into the combustion chamber 12 together with and with the aid of the fine refuse particles, so that it will dry very rapidly and become combusted very quickly directly in the hottest zone of the combustion chamber 12. This means that unlike the prior-art practice it is no longer necessary to extract as much of the water from the sewage sludge as was possible, but instead the sewage sludge can now be admixed with the fine refuse particles in a substantially wetter condition; for instance, it may contain up to 90% water and still be properly combusted.

It will be understood that each of the elements described above, or two or more together, may also find a useful application in other types of constructions differing from the type described above.

While the invention has been illustrated and described as embodied in an incinerator for incinerating unclassified refuse, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A refuse incinerator for unclassified refuse, comprising combustion chamber means having a lower end provided with a fire grate; first comminuting means for receiving and comminuting incoming unclassified refuse to convert it into a mix of particles of different sizes; classifying means for classifying said mix into a first fraction composed of heavier particles and a second fraction composed of lighter particles; first conduit means for conducting said first fraction from said classifying means directly onto said grate; second comminuting means connected with said classifying means for receiving said second fraction therefrom, and for comminuting it into fine particles of still smaller size; and second conduit means for conducting said fine particles into said combustion chamber means upwardly of said grate for incineration in floating state.

2. A refuse incinerator as defined in claim 1, wherein said second conduit means communicates directly with said combustion chamber means.

3. A refuse incinerator as defined in claim 1; and further comprising auxiliary burners communicating with said combustion chamber means.

4. A refuse incinerator for unclassified refuse, comprising combustion chamber means having a cover and provided with a fire grate; first comminuting means for receiving and comminuting incoming unclassified refuse to convert it into a mix of particles of different sizes; classifying means for classifying said mix into a first fraction composed of heavier particles and a second fraction composed of lighter particles; first conduit means for conducting said first fraction from said classifying means directly onto said grate; second comminuting means connected with said classifying means for receiving said second fraction therefrom, and for comminuting it into fine particles of still smaller size; second conduit means for conducting said fine particles into said combustion chamber means upwardly of said grate for incineration in floating state; and a storage reservoir interposed in said second conduit means into which said fine particles enter prior to their passage to said combustion chamber means.

5. A refuse incinerator as defined in claim 4; and further comprising a feeding device for feeding fine particles from said storage reservoir into said combustion chamber means.

6. A refuse incinerator for unclassified refuse, comprising combustion chamber means having a cover and provided with a fire grate; first comminuting means for receiving and comminuting incoming unclassified refuse to convert it into a mix of particles of different sizes; classifying means for classifying said mix into a first fraction composed of heavier particles and a second fraction composed of lighter particles; first conduit means for conducting said first fraction from said classifying means directly onto said grate; second comminuting means connected with said classifying means for receiving said second fraction therefrom, and for comminuting it into fine particles of still smaller size; second conduit means for conducting said fine particles into said combustion chamber means upwardly of said grate for incineration in floating state; and admitting means for admitting sewage sludge into said second conduit means for travel with said fine particles into and incineration in, said combustion chamber means.

7. A refuse incinerator for unclassified refuse, comprising combustion chamber means having a cover and provided with a fire grate; first comminuting means for receiving and comminuting incoming unclassified refuse to convert it into a mix of particles of different sizes; classifying means for classifying said mix into a first fraction composed of heavier particles and a second fraction composed of lighter particles; first conduit means for conducting said first fraction from said classifying means directly onto said grate; second comminuting means connected with said classifying means for receiving said second fraction therefrom, and for comminuting it into fine particles of still smaller size; second conduit means for conducting said fine particles into said combustion chamber means upwardly of said grate for incineration in floating state; and an admitting conduit for admitting sewage sludge into said second conduit means.

8. A refuse incinerator for unclassified refuse, comprising combustion chamber means having a cover and provided with a fire grate; first comminuting means for receiving and comminuting incoming unclassified refuse to convert it into a mix of particles of different sizes; classifying means for classifying said mix into a first fraction composed of heavier particles and a second fraction which is composed of lighter particles and contains a quantity of particles which cannot be further comminuted and converted into fine particles; first conduit means for conducting said first fraction from said classifying means directly onto said grate; second comminuting means connected with said classifying means for receiving said second fraction therefrom, and for comminuting the comminutable portion thereof into fine particles of still smaller size; a bypass conduit which conducts said quantity of particles from said second comminuting means onto said grate; and second conduit means for conducting said fine particles from said second comminuting means into said combustion chamber means upwardly of said grate for incineration in floating state.

9. A refuse incinerator as defined in claim 8, wherein said bypass conduit communicates with said first conduit means.

10. A method of incinerating unclassified refuse in a combustion chamber having a bottom grate, comprising the steps of admitting unclassified refuse into a comminutor and comminuting it to obtain a heavier particle fraction and a lighter particle fraction; conveying the heavier particle fraction directly onto said grate; admitting the lighter particle fraction into another comminutor and converting it therein into a fine particle fraction; and admitting said fine particle fraction into said combustion chamber upwardly of said grate for combustion in floating state in said combustion chamber.

* * * * *